US006313549B1

(12) United States Patent
Moisan et al.

(10) Patent No.: US 6,313,549 B1
(45) Date of Patent: Nov. 6, 2001

(54) EMERGENCY EVACUATION SYSTEM

(76) Inventors: John Moisan, 709 Two Rivers St., Ft. Pierre, SD (US) 57532-2046; Dale Engelmann, 904 LaFramboise Dr., P.O. Box 861, Ft. Pierre, SD (US) 57532

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/928,288

(22) Filed: Sep. 12, 1997

(51) Int. Cl.[7] ..... G08B 7/00

(52) U.S. Cl. ..... 307/66; 52/174; 340/333; 439/114

(58) Field of Search ..... 307/66, 147; 315/86; 340/333, 331, 332, 286.5; 322/88; 439/114; 52/27, 28, 36.1, 38, 61, 220.1, 220.7

(56) References Cited

U.S. PATENT DOCUMENTS

| | | | | |
|---|---|---|---|---|
| 3,916,404 | * | 11/1975 | Gouge | 340/332 |
| 3,976,986 | * | 8/1976 | Zabroski | 340/656 |
| 4,150,302 | * | 4/1979 | Roche | 307/66 |
| 4,223,232 | * | 9/1980 | Bulat | 307/66 |
| 4,297,614 | * | 10/1981 | Chandler | 315/86 |
| 4,385,586 | * | 5/1983 | Schriever | 116/205 |
| 4,453,222 | * | 6/1984 | Goszyk | 704/274 |
| 4,672,293 | * | 6/1987 | Crampton | 320/128 |
| 4,682,078 | | 7/1987 | Pascalide | 315/86 |
| 4,686,424 | | 8/1987 | Nuckolls et al. | 315/86 |
| 4,760,322 | * | 7/1988 | Crampton | 320/128 |
| 4,801,928 | * | 1/1989 | Minter | 340/332 |
| 5,024,614 | * | 6/1991 | Dola et al. | 439/114 |
| 5,149,185 | | 9/1992 | Mandy | 362/20 |
| 5,185,536 | * | 2/1993 | Johnson, Jr. et al. | 307/66 |
| 5,252,891 | | 10/1993 | Huang | 315/86 |
| 5,365,145 | | 11/1994 | Fields | 315/86 |
| 5,416,384 | | 5/1995 | Bavaro | 315/86 |
| 5,775,016 | * | 7/1998 | Chien | 362/84 |
| 6,025,773 | * | 2/2000 | Bresnan | 340/331 |

* cited by examiner

*Primary Examiner*—Josie Ballato
*Assistant Examiner*—Peter Zura
(74) *Attorney, Agent, or Firm*—Birch, Stewart, Kolasch & Birch, LLP

(57) ABSTRACT

Embodiments of an emergency evacuation system are disclosed which may be installed within the knockouts of a panel of a modular work space system. During normal operation a battery power source within the emergency evacuation system is charged by normal AC power supplied through the modular work space system. In the event of a power outage or fire, the battery power source serves to operate emergency lighting.

27 Claims, 3 Drawing Sheets

EMERGENCY EVACUATION SYSTEM

BACKGROUND OF THE INVENTION

1. Field of the Invention

The present invention relates generally to the field of modular work space systems and more particularly to a system to provide for emergency evacuation of such systems.

2. Background Information

Throughout this country and around the world it has become increasingly popular to create work spaces using modular walls to partition a large, open area. Typically a large open area is broken up into smaller offices or work stations by connecting modular walls to create halls and interior working areas. Several manufacturers make and market modular system wall panels which are provided in various lengths and heights. These conventional wall panels may, with relative ease, be connected in various configurations to create walls, rooms, and hallways made up of a number of wall panels. Such wall panels ordinarily provide a built-in method of transmitting various utilities including electrical power, computer lines, and telephone lines with outlets in each panel. When the panels are connected the utility transmissions lines are also connected. Panels are usually connected together in a group or series and each series is connected through one panel to the building utilities. Typically such utility lines are located in a raceway along the bottom of each panel and means are provided for installing conventional electrical outlets, telephone connections, and dedicated computer lines at various locations is each workspace and along each wall or corridor. Ordinarily the raceway in a modular panel includes several "knockouts" in the outer wall of the raceway and these knockouts may be removed to allow access to the utility lines. Connectors, including electrical connectors, are provided at the knockouts to which a variety or outlets etc. may be connected. Mounting brackets are also provided to which the outlets may be attached.

As in any office or work area, modular work space systems should include a method of emergency evacuation. Office and work area emergencies can occur for a variety of reasons including power outages, fires, tornadoes, hurricanes, etc. In some instances, such as a gas leak, emergency personnel intentionally cut power to an office area to eliminate or reduce dangerous conditions. In instances where power to a work area is cut, many areas become to dark for workers to find there way. In cases of fire, for example, the presence of smoke may increase darkness and contribute to worker disorientation and confusion. By their very nature emergency situations have a tendency to induce panic and it is critical to provide a workable method for evacuating an office or work area in an emergency situation. Modular systems furniture often contributes to difficulties in emergency evacuation because all the panels and most of the work areas look the same and, therefore, may add to the confusion and disorientation present in emergency situations.

In most work areas at least some provisions have been made to facilitate evacuations in emergencies. Typically, battery powered emergency lighting is provided above exits. However, because of the limited number of such lights and because of their placement near the ceiling, in many instances, a number of areas in the work space are without light or shadowed in emergency situations. In addition most large work areas have an emergency evacuation plan which is posted with evacuation routes for workers mapped out hi an emergency situation such posted evacuation routes are of limited use because workers are unfamiliar with them, or forget them in the panic of an emergency, or become disoriented and can't follow the suggested route.

A significant number of devices which alleviate at least some of the problems related to the evacuation of buildings in emergency situations have been patented. Most of these patented solutions only provide for emergency lighting. The patent to Bavaro, for example, (U.S. Pat. No. 5,416,384; May 16, 1995) discloses aback-up lighting system which utilizes a modular design to include driving circuitry, a rechargeable and replaceable battery pack, battery recharging circuitry, DC relays to connect the battery back-up to the driving circuit and disconnect AC mains power from the lamp circuitry, user controls, a photo-sensing mechanism, and a test mechanism. The patent to Fields (U.S. Pat. No. 5,365,145; Nov. 15, 1994) discloses another emergency lighting system. The system includes a source of AC power connected with a step-down transformer, an AC power rectifier connected with the low voltage winding on the transformer, an emergency battery power source connected to the low voltage DC power terminal of the rectifier for storage of that power, a low voltage incandescent lamp connected to the battery power source, and a control relay which senses that the main AC power is out and connects the lamp to the DC power of the battery power source.

The instant invention is an emergency evacuation system which is unique, original, and fills the need for a new and improved system for the evacuation of modular office system furniture areas in emergency situations.

The ideal emergency evacuation system should provide a workable system for the evacuation of a modular systems furniture office area in a variety of emergency situations. The ideal emergency evacuation system should provide for emergency lighting at floor level at all areas of the work space rather than just at a few selected locations. The ideal emergency evacuation system should not rely upon ordinary mains power and have an independent power source. The ideal emergency evacuation system should also include a method for automatically directing evacuees along prescribed evacuation routes. The ideal emergency evacuation system should also provide for audio as well as visual alarms. The ideal emergency evacuation system should also be capable of providing alarms for the hearing and visually impaired. The ideal emergency evacuation system should also be easy to install using readily available tools, equipment and facilities. The ideal emergency evacuation system should also be durable and require little or no maintenance. The ideal emergency evacuation system should also be simple to use, uncomplicated, compact, and inexpensive.

SUMMARY OF THE INVENTION

The emergency evacuation system of the instant invention provides a modular unit which may be inserted within the knockout of the raceway of a modular system furniture panel and connected to the provided power line using the provided electrical connector. In addition to the electrically connection, the modular unit may be physically mounted to the provided mounting bracket by means of a screw. Included within the modular unit are the electrical connector, a step-down transformer, a solid state electrical circuit, a battery pack, a mirror, a light bulb, and a lens. The transformer, the solid state electrical circuit, the battery pack, and the light are connected such that during non-emergency operation, the mains AC power supplied to the panel is used to maintain the charge in the battery pack.

When ordinary mains AC power is cut the solid state electrical circuit senses that the power has been cut and directs the power from the battery pack to light the light bulb.

In an emergency the mirror reflects the light from the light bulb away from the interior of the modular unit. The light from the light bulb and reflected from the mirror is projected through the directional lens to the hallway or corridor floor of the modular work area and provides emergency lighting. A removable arrow may be placed upon the outer surface of the lens to indicate the approved emergency evacuation route.

The modular unit containing the emergency evacuation system may be placed within as many modular system furniture wall panels as are necessary to provide emergency lighting, alarms, and directional arrows to all areas of the modular work space system.

In other embodiments the emergency evacuation system may be equipped with an emergency siren. The emergency evacuation system may also be equipped with a blinking light to act as an alarm for the hearing impaired. The emergency evacuation system may also be connected directly to an existing fire alarm system so that the emergency evacuation system is activated when the alarm is activated regardless of the presence or absence of normal mains power.

One of the major objectives of the instant invention is to provide a workable system for the evacuation of a modular office area in a variety of emergency situations.

Another objective of the emergency evacuation system is provide for emergency lighting projected onto the floor at all areas of the work space rather than just at a few selected locations near ceiling level.

Another objective of the emergency evacuation system is not to rely upon ordinary main power and to have an independent power source.

Another objective of the emergency evacuation system is to include a method for automatically directing evacuees along prescribed evacuation routes.

Another objective of the emergency evacuation system is to provide for audio as well as visual alarms.

Another objective of the emergency evacuation system is to provide alarms for hearing and visually impaired personnel.

Another objective of the emergency evacuation system is to provide a system which is easy to install using readily available tools, equipment and facilities.

Another objective of the emergency evacuation system is that it be durable and require little or no maintenance.

Another objective of the emergency evacuation system is to be simple to use, uncomplicated, compact, and inexpensive.

These and other features of the invention will become apparent when taken in consideration with the following detailed description and the drawings.

DESCRIPTION OF A PREFERRED EMBODIMENT

Figure 1:
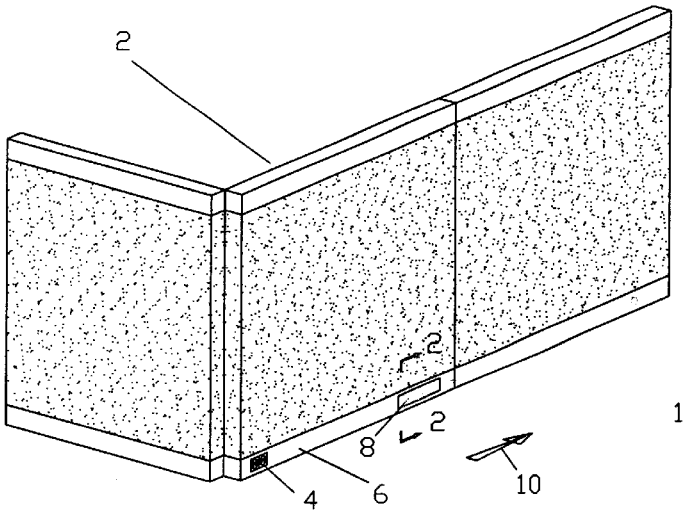
FIG. 1 is a perspective view of a section of a typical modular work space system including a preferred embodiment of the emergency evacuation system of the present invention.

Referring to the drawings, FIGS. 1 through 6, there is shown a preferred form of the emergency evacuation system embodying the present invention.

Referring to FIG. 1, perspective view of a section of a typical modular work space system including a preferred embodiment of the emergency evacuation system is shown. A single panel 2 may be attached to a combination of other panels to form a variety of shapes to create different configurations of work spaces. The panel 2 represents any of a number of modular units currently produced by several manufacturers. Although the various versions of said panel 2 produced include different methods of attachment etc., they ordinarily include a number of electrical outlets 4 and a raceway 6. The raceway 6 typically includes lines for transmitting various utilities including electrical power, computer lines, and telephone lines. Knockouts 8 are provided in the outer walls of said raceway 6 which may be removed to allow access to the utility lines within said raceway 6. In most areas using said panels 2 to create a modular work space, an evacuation plan has been developed to guide workers in the event an emergency evacuation becomes necessary. The arrow 10 indicates the direction of an emergency evacuation route in FIG. 1.

Figure 2:
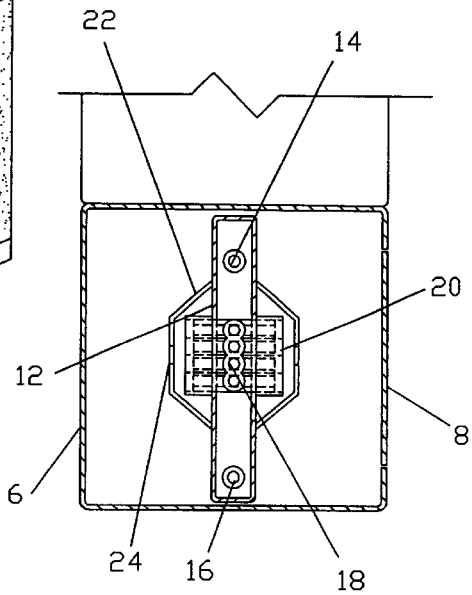
FIG. 2 is a sectional view of a preferred form of the present invention taken along line 2—2 of FIG. 1.

Referring now to FIG. 2, a sectional view of said raceway 6 is shown including a knockout 8. Although there are variations in the configurations of said raceways 6 made by different manufacturers, the included elements are similar. The interior of said raceway 6 typically includes a utility conduit 12 which includes the various utility lines ordinarily including a computer line 14 and a telephone line 16. The utility conduit 12 also includes a power line 18 for transmission of electrical power and a number of power connectors 20. The power connectors 20 are included so that any of a number of electrical devices may be connected to the building's electrical power system. A mounting bracket 22 is attached to said utility conduit 12 for mounting electrical devices to said utility conduit 12. The mounting bracket 22 includes a bracket hole 24 to facilitate the mounting of electrical devices. Said knockout 8 may be removed to allow access to said utility conduit 12.

Figure 3:
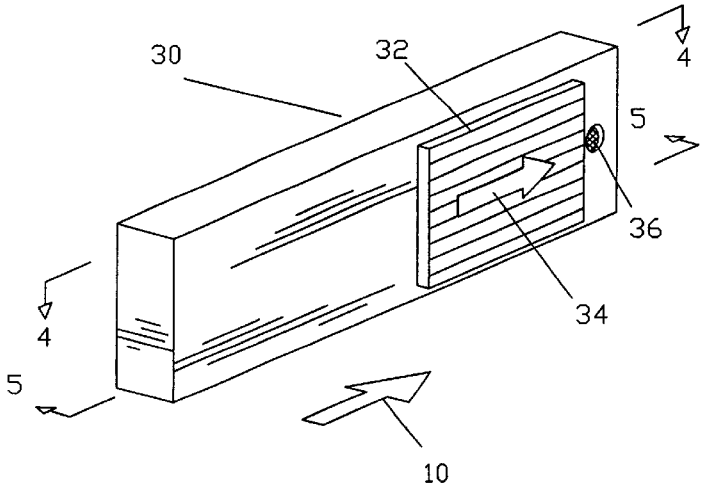
FIG. 3 is a perspective view of a preferred form of the emergency evacuation system of the present invention similar to the view shown in FIG. 1, but without showing the modular work space system.

Referring to FIG. 3, a perspective view of the emergency evacuation system of the present invention is shown. The emergency evacuation system is enclosed within a modular unit 30. In operation said knockout 8 is removed and the modular unit 30 fits within the exposed space with the face shown exposed to a hallway or corridor in the modular office space. The outer face of said modular unit 30 includes a lens 32. The lens 32 is secured to an exterior surface of a housing 47. A direction arrow 34 may be placed upon the outer face of the lens 32 to indicate the direction of the emergency evacuation route as indicated by the arrow 10. There is a mounting hole 36 which passes through said modular unit 30.

Figure 4:
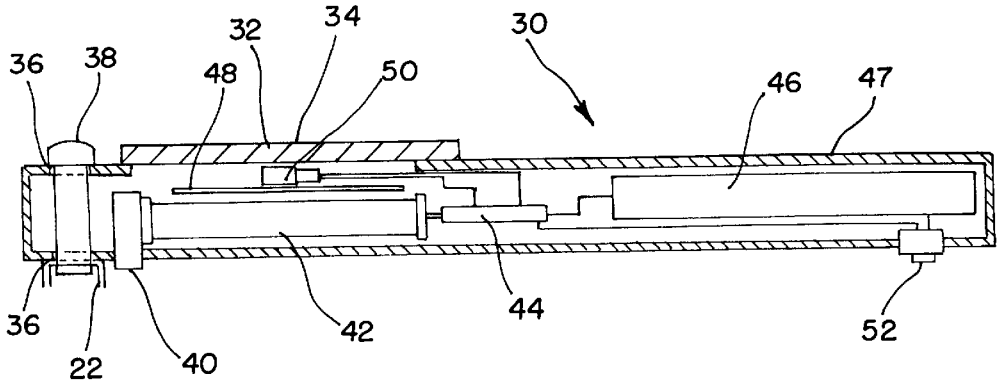
FIG. 4 is a sectional view of a preferred form of the present invention taken along line 4—4 of FIG. 3.
Figure 5:
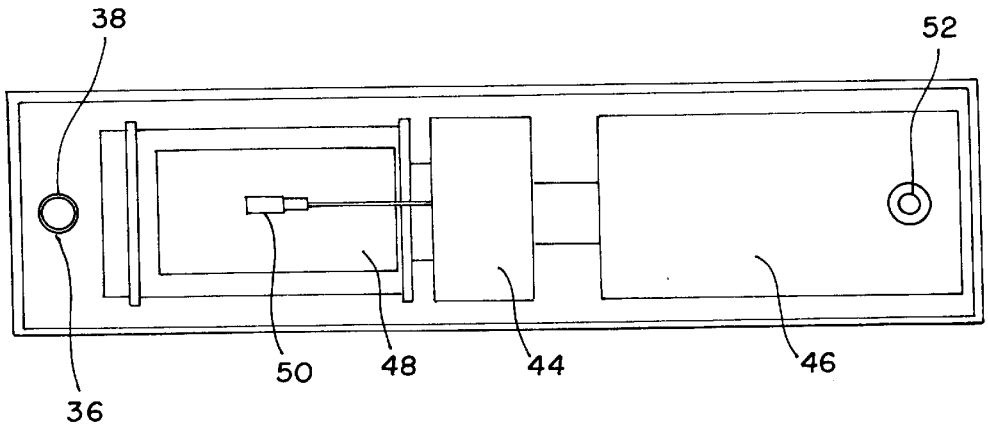
FIG. 5 is a sectional view of a preferred form of the present invention taken along line 5—5 of FIG. 3.

Referring now to FIG. 4, a cross sectional view of said modular unit 30 is shown. Said lens 32 allows the passage of light from the interior of said modular unit 30 to a hallway or corridor in the modular office space. Said modular unit 30 is attached to said mounting bracket 22 by means of a bolt 38 which passes through the mounting hole 36. Normal power for the emergency evacuation system is supplied by connecting a unit connector 40 to said power connector 20 in said raceway 6. The unit connector 40 is connected to a transformer 42. The transformer 42 is also connected to a circuit board 44. A battery pack 46 is also supplied. A mirror 48 reflects light from a bulb 50 outward through said lens 32. The bulb 50 is connected to the circuit board 44. Said circuit board 44 is also connected to a switch 52 which is also connected to the battery pack 46. The other pole of said battery pack 46 is also connected to said circuit board 44. The other pole of said bulb 50 is also connected to said circuit board 44.

Where FIG. 4 shows a top view of the interior of said modular unit 30, FIG. 5 shows a side view of the interior of said modular unit 30.

Figure 6:
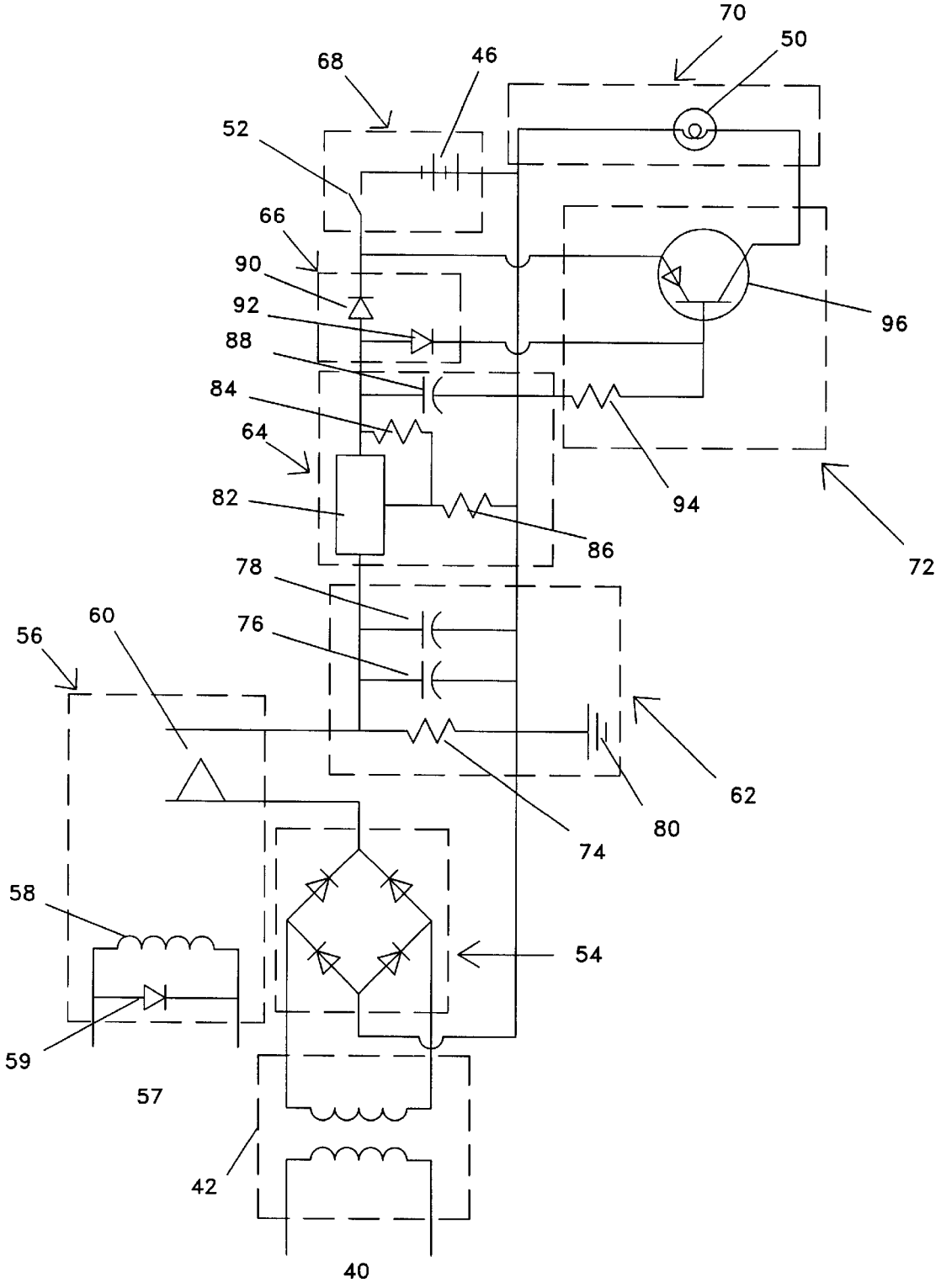
FIG. 6 is a schematic diagram of the electrical elements of the circuit board and connected elements shown in FIGS. 4 and 5.

Referring now to FIG. 6, a schematic diagram of the electrical circuits of said circuit board 44 and connected elements shown in FIGS. 4 and 5 is shown. The electrical circuits include several connected modules which each contain one or more electrical elements. The primary winding of said transformer 42 is connected to said unit connector 40. Said transformer steps the normal 110 V AC down to 5 V AC and is connected by its secondary winding to a bridge rectifier 54. The bridge rectifier 54 converts the 5 V AC to 5 V pulsating DC. Said bridge rectifier 54 is connected to a fire control relay 56 which routes the 5 V pulsating DC to a filter network 62. The filter network 62 eliminates electrical variations in the 5 V pulsating DC and also converts the current to 5 V DC which does not pulsate. Said filter network 62 routes current to a regulated charging network 64. The regulated charging network 64 regulates the DC from said filter network to insure proper charging voltage and current and routes current to a steering network 66. The steering network 66 controls the charging voltage and current to a battery power source 68. The battery power source 68 provides current for output elements 70 and for a switch network 72 connected to the output elements 70.

Said fire control relay 56 is connected to the fire alarm system of the building 57 through a control relay coil 58 and also includes control relay contacts 60. A diode 59 between the control relay coil 58 and the fire alarm circuit of the building controls electrical spikes. Said filter network 62 includes a filter resister 74, a first filter capacitor 76, and a second filter capacitor 78 which are connected in parallel. In addition to being connected to said fire control relay 56, said filter network 62 is also connected to said bridge rectifier 54. Said filter network 62 is also connected to a filter ground 80. The filter ground 80 is an isolated ground. Said regulated charging network includes a regulator 82 which is connected to a first bias resistor 84 and a second bias resistor 86. Said regulated charging network 64 also includes a charging capacitor 88. Said steering network 66 includes a first steering diode 90 which is between said regulated charging network 64 and said battery power source 68 and a second steering diode 92 which is between said switch network 72 and said regulated charging network 64. Said battery power source 68 includes switch 52 and said battery pack 46. Said output elements 70 include said bulb 50. Said switch network 72 includes a biasing resistor 94 which is connected to said filter ground 80 and a switching transistor 96. The switching transistor 96 is also connected to said bulb 50 and between said steering network 66 and said battery power source 68.

In normal, non-emergency, operation current flows through said transformer 42, through said bridge rectifier 54, through said fire control relay 56, through said filter network 62, through said regulated charging network 64, through said steering network 66, and charges said battery pack 46 in said battery power source 68. Said control relay contacts 60 are connected in this mode of operation which allows normal, non-emergency, AC to flow through the system. The various modules in the circuit insure that the proper current and voltage reach said battery pack 46. Charging capacitor 88 eliminates common electrical spikes from said regulator 82. The first steering diode 90 prevents DC from said battery pack 46 from back feeding to said regulator charging network 64. The second steering diode 92 routes current to the transistor 96 and prevents it from conducting electricity in normal, non-emergency, operation. Said switch 52 is open prior to installation of the emergency evacuation system. After installation or for testing or other purposes, said switch 52 is closed and the emergency evacuation system circuitry activated.

Emergency operation may be initiated by a variety of causes such as fire or electrical outage. In an emergency situation the emergency evacuation system may be activated by either of two means. If either normal power to said transformer 42 is cut or the building alarm system is activated, said fire control relay 56 cuts off outside power from the emergency evacuation system circuitry and said control relay contacts 60 open. Once the outside power is cut, said second steering diode 92 no longer routes current to said transistor 96 and said transistor 96 then conducts electricity because of biasing resistor 94. The second steering diode 92 prevents DC from said battery pack 46 from back feeding to said regulator charging network 64. Power then flows only from said battery power source 68 through the collector of said transistor 96 and through said output elements 70. This lights said bulb 50. Although the preferred embodiment of the emergency evacuation system shows only a bulb 50 within said output elements 70, other devices could be added including a strobe element or an alarm buzzer. Such other devices could be used with said bulb 50 or in any combination.

The emergency evacuation system may be installed within the provided knockout 8 in the raceway 6 of a panel 2 of a modular work space system. In normal, non-emergency, operation, the emergency evacuation system is supplied with electrical power supplied within said raceway 6 through said power line 18 by connecting the emergency evacuation system to said power connector 20. Through the circuitry supplied with the emergency evacuation system, this electrical power is used to charge said battery pack 46. In an emergency, if either outside power is cut or the building's fire alarm system is activated, the circuitry of the emergency evacuation system is isolated from the building's circuits. Electrical power from said battery pack 46 then operates the elements in said output elements 70. These elements include said bulb 50 and may also include other elements such as a strobe element or alarm buzzer. Light from said bulb 50 is reflected by the mirror 48 outward through said lens 32 to provide emergency lighting in the event that the emergency causes reduced vision through darkness, smoke, or similar event. The direction arrow 34 may be attached to the outside of said lens 32 to indicate the direction of the preferred emergency evacuation route. The strobe element may be added to provide additional warning for the hearing impaired and the alarm buzzer element may be added to auditory warning.

In the preferred embodiment of the emergency evacuation system all structural parts are made of plastic, but other materials having similar properties could be used. All other elements are conventional and available from any of a number of suppliers.

While preferred embodiments of this invention have been shown and described above, it will be apparent to those skilled in the art that various modifications may be made in these embodiments without departing from the spirit of the present invention. For that reason, the scope of the invention is set forth in the following claims:

What is claimed is:

1. In a component system of movable systems furniture including work surfaces, cabinets, drawers and movable wall panels connected together to form various work spaces and walkways, an emergency evacuation system module for installation in a lower raceway of at least one movable wall panel installed within a building, the building having one or more exits for providing an illuminated pathway exit for enabling an individual to exit the building, and said lower raceway having normal AC power supplied through the raceway which is available for use by electrical devices comprising:

an opening formed in said lower raceway, said opening being of a predetermined size;

a transformer being positioned within said opening in said lower raceway with the source of normal AC power within the modular work space system supplied through the raceway connected to the emergency evacuation system module through said transformer within the emergency evacuation system module capable of transforming such normal AC power into low voltage AC power and forming an AC circuit;

means within the emergency evacuation system module capable for rectifying the low voltage AC power and providing low voltage DC power;

a battery power source being positioned within the emergency evacuation system module and connected to the low voltage DC power such that the battery power source receives and stores the low voltage DC power;

a low voltage incandescent bulb within the emergency evacuation system module connected to said battery power source, forming a DC circuit with said battery power source, and capable of being operated by said battery power source; and control delay means within the emergency evacuation system module connected to the AC circuit and the DC circuit and capable of sensing a loss of normal AC power in said AC circuit and activating said DC circuit such that the low voltage incandescent bulb is powered and operated by said battery power source;

whereby, normal AC power is used to charge said battery power source when normal AC power is present and, in the event that normal AC power fails or is terminated, said battery power source powers and operates said low voltage incandescent bulb to provide emergency lighting for identifying a pathway for an individual to exit the building.

2. In a component system of movable systems furniture including work surfaces, cabinets, drawers and movable wall panels connected together to form various work spaces and walkways, the emergency evacuation system module of claim 1 in which the emergency evacuation system is installed in the building, the building having an alarm system wherein said control relay is hard wired to the alarm system in the building, said control relay is capable of detecting when said alarm system is activated, and, when said alarm system is activated, said control relay is capable of terminating the flow of normal AC power to said DC circuit causing said battery source to power and operate said low voltage incandescent bulb.

3. In a component system of movable systems furniture including work surfaces, cabinets, drawers and movable wall panels connected together to form various work spaces and walkways, the emergency evacuation system module of claim 1 in which a lens is positioned between said low voltage incandescent bulb and the walkways of the modular work space system and an arrow is affixed to the lens such that the arrow is illuminated by said low voltage incandescent bulb in emergency situations in which visibility is reduced due to smoke, lack of normal lighting or similar circumstances and indicates the direction of the safe exits from the building.

4. In a component system of movable systems furniture including work surfaces, cabinets, drawers and movable wall panels connected together to form various work spaces and walkways, the emergency evacuation system module of claim 2 in which a lens is positioned between said low voltage incandescent bulb and the walkways of the modular work space system and an arrow is affixed to the lens such that the arrow is illuminated by said low voltage incandescent bulb in emergency situations in which visibility is reduced due to smoke, lack of normal lighting or similar circumstances and indicates the direction of the safe exits from the building.

5. In a component system of movable systems furniture including work surfaces, cabinets, drawers and movable wall panels connected together to form various work spaces and walkways, the emergency evacuation system module of claim 1, further comprising an audible alarm device.

6. In a component system of movable systems furniture including work surfaces, cabinets, drawers and movable wall panels connected together to form various work spaces and walkways, the emergency evacuation system module of claim 5, wherein the audible alarm device includes one of a voice chip and an alarm buzzer.

7. In a component system of movable systems furniture including work surfaces, cabinets, drawers and movable wall panels connected together to form various work spaces and walkways, the emergency evacuation system module of claim 1, further comprising a strobe element connected to the battery.

8. In a component system of movable systems furniture including work surfaces, cabinets, drawers and movable wall panels connected together to form various work spaces and walkways, an emergency evacuation system module for installation in a raceway of at least one movable wall panel installed within a building, the building having one or more exits for providing an illuminated pathway exit for enabling an individual to exit the building, and the raceway having normal AC power supplied through the raceway which is available for used by electrical devices comprising:

an opening formed in said raceway, said opening being of a predetermined size;

a transformer being positioned within said opening in said raceway with the source of normal AC power within the modular work space system supplied through the raceway connected to the emergency evacuation system module through said transformer within the emergency evacuation system module capable of transforming such normal AC power into low voltage AC power and forming an AC circuit; the primary winding of the transformer being connected to the normal AC power;

a bridge rectifier within the emergency evacuations system module connected to the secondary winding of said transformer and capable of converting the AC of the AC circuit into pulsating DC and forming a DC circuit;

a filter network within the emergency evacuation system module connected to the bridge rectifier, the filter network capable of converting the pulsating DC in non-pulsating DC;

a regulated charging network within the emergency evacuation system module connected to said filter network, the regulated charging network capable of regulating the non-pulsating DC to appropriate voltage and current for the charging a battery power source;

a steering network within the emergency evacuation system module connected to the regulated charging network, the steering network capable of controlling voltage and current such that they are appropriate for charging a battery power source;

a battery power source being positioned within the emergency evacuation system module and connected to the steering network, the battery power source capable of receiving the storing DC from said steering network;

a low voltage incandescent bulb within the emergency evacuation system module connected to said battery power source; and a switching network within the emergency evacuation system module connected to said steering network and connected to the low voltage incandescent bulb, the switching network capable of sensing a loss of normal AC power and, in the event of such loss of normal AC power, capable of causing DC from said batter power source to operate said low voltage incandescent bulb;

whereby, normal AC power is used to charge said battery power source when normal AC power is present and, in the event that normal AC power fails or is terminated, said battery power source powers and operates said low voltage incandescent bulb to provide emergency lighting for identifying a pathway for an individual to exit the building.

9. In a component system of movable systems furniture including work surfaces, cabinets, drawers and movable wall panels connected together to form various work spaces and walkways, the emergency evacuation system module of claim 8 in which the emergency evacuation system is installed in the building, the building having an alarm system and the alarm system sending a signal that the alarm system has been activated and a fire control relay is connected to the alarm system and is capable of detecting the signal indicating that the alarm system is activated, the fire control relay being further connected to said bridge rectifier and to said filter network such that said fire control relay is capable of terminating the flow of normal AC power to said DC circuit in the event the alarm system in the building is activated and causing said battery source to power and operate said low voltage incandescent bulb.

10. In a component system of movable systems furniture including work surfaces, cabinets, drawers and movable wall panels connected together to form various work spaces and walkways, the emergency evacuations system module of claim 8 in which a lens is positioned between said low voltage incandescent bulb and the walkways of the modular work space system and an arrow is affixed to the lens such that the arrow is illuminated by said low voltage incandescent bulb in emergency situations in which visibility is reduced due to the smoke, lack of normal lighting or similar circumstances and indicates the direction of the safe exits from the building.

11. In a component system of movable systems furniture including work surfaces, cabinets, drawers and movable wall panels connected together to form various work spaces and walkways, the emergency evacuation system module of claim 6 in which a lens is positioned between said low voltage incandescent bulb and the walkways of the modular work space system and an arrow is affixed to the lens such that he arrow is illuminated by said low voltage incandescent bulb in emergency situations in which visibility is reduced due to smoke, lack of normal lighting or similar circumstances and indicates the direction of the safe exits from the building.

12. In a component system of movable systems furniture including work surfaces, cabinets, drawers and movable wall panels connected together to form various work spaces and walkways, an emergency evacuation system module for installation in a raceway of at least one movable wall panel installed within a building, the building having one or more exits, for providing an illuminated pathway exit for enabling an individual to exit the building and the raceway having normal AC power supplied through the raceway which is available for use by electrical devices comprising:

an opening formed in said lower raceway, said opening being of a predetermined size;

a system module capable of being inserted into the opening in said raceway at the base of a panel of such modular work space system, the system module being installed such that it is visible in such walkways, and said system module capable of being plugged into and connected to the normal AC power in the raceway;

a light source within said system module, the light source being capable of illuminating such walkway when illuminated;

means for powering said light source not depending upon the normal AC power; and a sensor within said system module, the sensor capable of sensing that the normal AC power has been interrupted and of sending a signal which causes said light sources to be illuminated using the means for powering said light sources and causes the walkway to be illuminated;

whereby, if normal AC power to the building is interrupted and normal lighting is thereby interrupted, the emergency evacuation system module provides emergency lighting for identifying a pathway for an individual to exit the building.

13. In a component system of movable systems furniture including work surfaces, cabinets, drawers and movable wall panels connected together to form various work spaces and walkways, the emergency evacuation system module of claim 12 in which the building has an alarm system and the emergency evacuation system included an alarm sensor capable of determining that the alarm system has been activated and sends a signal which causes said light source and causes the walkway to be illuminated.

14. In a component system of movable systems furniture including work surfaces, cabinets, drawers and movable wall panels connected together to form various work spaces and walkways, a modular system wall panel comprising:

a base portion and a top portion; and a raceway disposed along the base portion of the modular wall panel and extending along the length of the modular wall panel, the raceway having an essentially box-shaped cross-section, the raceway including:

a conduit suitable for housing a power line, the conduit extending along the length of the wall panel;

an aperture in a surface of the raceway;

a power source;

a bulb connected to the power source; and a lens mounted proximate to the surface of the raceway containing the aperture, the lens being visible from an exterior of the modular wall panel and having a direction arrow, the direction arrow providing a visual indication of a direction when the bulb is supplied with power for identifying a pathway for an individual to exit the building.

15. In a component system of movable systems furniture including work surfaces, cabinets, drawers and movable wall panels connected together to form various work spaces and walkways, the modular system wall panel of claim 14, wherein the raceway includes a telephone line extending through the conduit.

16. In a component system of movable systems furniture including work surfaces, cabinets, drawers and movable wall panels connected together to form various work spaces and walkways, the modular system wall panel of claim 14, wherein the power source includes a battery.

17. In a component system of movable systems furniture including work surfaces, cabinets, drawers and movable wall panels connected together to form various work spaces and walkways, the modular system wall panel of claim 16, wherein the raceway further includes a control relay, the control relay being responsive to an external signal to enable the battery to supply power to the bulb.

18. In a component system of movable systems furniture including work surfaces, cabinets, drawers and movable wall panels connected together to form various work spaces and walkways, the modular system wall panel of claim 14, wherein the raceway further includes an audible alarm device.

19. In a component system of movable systems furniture including work surfaces, cabinets, drawers and movable wall panels connected together to form various work spaces and walkways, the modular system wall panel of claim 18, wherein the audible alarm device includes a voice chip.

20. In a component system of movable systems furniture including work surfaces, cabinets, drawers and movable wall panels connected together to form various work spaces and walkways, the modular system wall panel of claim 18, wherein the audible alarm device includes an alarm buzzer.

21. In a component system of movable systems furniture including work surfaces, cabinets, drawers and movable wall panels connected together to form various work spaces and walkways, the modular system wall panel of claim 14, further comprising a strobe element, the strobe element being responsive to the power source to emit a strobe signal.

22. In a component system of movable systems furniture including work surfaces, cabinets, drawers and movable wall panels connected together to form various work spaces and walkways, the modular system wall panel of claim 14, wherein the raceway includes a housing, the power source and the bulb being located within the housing.

23. In a component system of movable systems furniture including work surfaces, cabinets, drawers and movable wall panels connected together to form various work spaces and walkways, a modular system wall panel comprising:

a base portion and a top portion;

a raceway disposed along the base portion of the modular wall panel and extending along a length of the modular wall panel, the raceway having an essentially box-shaped cross-section and including a conduit suitable for housing a power line, the conduit extending along a length of the modular wall panel; and a module at least partially disposed within said raceway, the module including, a housing, a power source, a light source electrically connected to the power source, and a lens, the lens being connected to the housing and being visible from an exterior of the modular system wall panel, wherein the lens includes a direction-indicating indicia, the direction-indicating indicia indicating a direction of travel when the light source is supplied with power for identifying a pathway for an individual to exit the building.

24. In a component system of movable systems furniture including work surfaces, cabinets, drawers and movable wall panels connected together to form various work spaces and walkways, the modular system wall panel of claim 23, wherein the light source and the power source are disposed within the housing, and the lens is mounted to an exterior surface of the housing.

25. In a component system of movable systems furniture including work surfaces, cabinets, drawers and movable wall panels connected together to form various work spaces and walkways, the modular system wall panel of claim 23, wherein: the module includes a switch, the switch being disposed on an exterior surface of said housing; and when the module is mounted within the raceway, the switch is closed.

26. In a component system of movable systems furniture including work surfaces, cabinets, drawers and movable wall panels connected together to form various work spaces and walkways, the modular system wall panel of claim 23, wherein the raceway includes an aperture, the module being mounted proximate the aperture and the direction indicating indicia being visible through the aperture.

27. In a component system of movable systems furniture including work surfaces, cabinets, drawers and movable wall panels connected together to form various work spaces and walkways, the modular system wall panel of claim 23, wherein the module includes a unit connector for connection with a power line extending through the conduit, the unit connector being disposed on a side of the module opposite to the lens.

* * * * *